US006196007B1

(12) United States Patent
Schlosser et al.

(10) Patent No.: US 6,196,007 B1
(45) Date of Patent: Mar. 6, 2001

(54) ICE MAKING MACHINE WITH COOL VAPOR DEFROST

(75) Inventors: Charles E. Schlosser; Cary J. Pierskalla, both of Manitowoc; Scott J. Shedivy, Two Rivers; Michael R. Lois, Manitowoc, all of WI (US)

(73) Assignee: Manitowoc Foodservice Group, Inc., Manitowoc, WI (US)

( * ) Notice: Subject to any disclaimer, the term of this patent is extended or adjusted under 35 U.S.C. 154(b) by 0 days.

(21) Appl. No.: 09/363,754

(22) Filed: Jul. 29, 1999

Related U.S. Application Data

(60) Provisional application No. 60/103,437, filed on Oct. 6, 1998.

(51) Int. Cl.[7] ..... F25C 5/10
(52) U.S. Cl. ..... 62/73; 62/278; 62/352
(58) Field of Search ..... 62/73, 81, 278, 62/352

(56) References Cited

U.S. PATENT DOCUMENTS

| | | | | |
|---|---|---|---|---|
| 2,960,840 | | 11/1960 | Hosken et al. | 62/278 |
| 3,343,375 | | 9/1967 | Quick | 62/81 |
| 3,427,819 | * | 2/1969 | Seghetti | 62/278 |
| 3,464,226 | | 9/1969 | Kramer | 62/278 |
| 3,511,060 | * | 5/1970 | Bodcher | 62/278 |
| 3,677,025 | | 7/1972 | Payne | 62/81 |
| 3,766,744 | | 10/1973 | Morris, Jr. | 62/73 |
| 3,822,562 | * | 7/1974 | Crosby | 62/278 |
| 4,023,377 | | 5/1977 | Tomita | 62/196 B |
| 4,044,568 | | 8/1977 | Hagen | 62/73 |
| 4,187,690 | | 2/1980 | Lindahl | 62/138 |
| 4,276,751 | | 7/1981 | Saltzman et al. | 62/138 |
| 4,346,566 | | 8/1982 | McCarty et al. | 62/159 |
| 4,373,345 | | 2/1983 | Tyree, Jr. et al. | 62/79 |
| 4,404,810 | | 9/1983 | Garland | 62/73 |
| 4,420,943 | | 12/1983 | Clawson | 62/81 |
| 4,437,317 | | 3/1984 | Ibrahim | 62/81 |
| 4,457,138 | | 7/1984 | Bowman | 62/196.1 |
| 4,522,037 | | 6/1985 | Ares et al. | 62/196.4 |
| 4,580,410 | * | 4/1986 | Toya | 62/352 |
| 4,621,505 | | 11/1986 | Ares et al. | 62/509 |
| 5,031,409 | | 7/1991 | Johnson | 62/73 |
| 5,218,830 | | 6/1993 | Martineau | 62/73 |
| 5,323,621 | | 6/1994 | Subera et al. | 62/196.4 |
| 5,381,665 | | 1/1995 | Tanaka | 62/197 |
| 5,669,222 | | 9/1997 | Jaster et al. | 62/156 |
| 5,694,782 | * | 12/1997 | Alsenz | 62/278 |
| 5,787,723 | | 8/1998 | Mueller et al. | 62/347 |

FOREIGN PATENT DOCUMENTS

| | | |
|---|---|---|
| 43 38 151 A1 | 3/1994 | (DE) . |
| 0 676 601 A1 | 10/1995 | (EP) . |

OTHER PUBLICATIONS

One page diagram showing Hussman "Super Plus Fibertronic Refrigeration System", undated (but published before Oct. 6, 1998).

* cited by examiner

*Primary Examiner*—William E. Tapolcal
(74) *Attorney, Agent, or Firm*—Brinks Hofer Gilson & Lione; Steven P. Shurtz

(57) ABSTRACT

An ice making machine has a water system, including a pump, an ice-forming mold and interconnecting lines therefore; a refrigeration system, including a compressor, a condenser, an expansion device, an evaporator in thermal contact with the ice-forming mold, and a receiver. The receiver has an inlet connected to the condenser, a liquid outlet connected to the expansion device and a vapor outlet connected by a valved passageway to the evaporator.

26 Claims, 10 Drawing Sheets

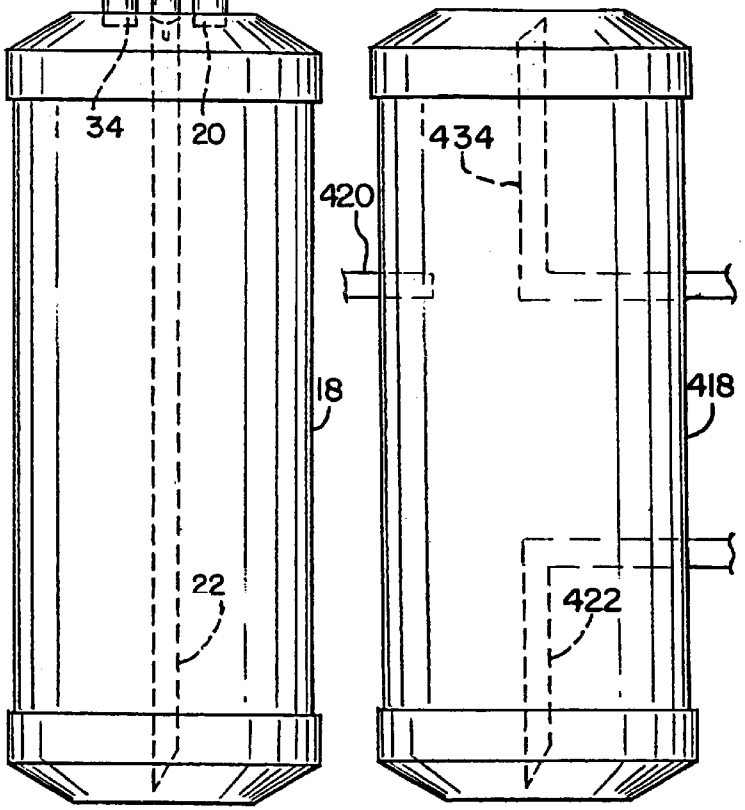
FIG. 6A
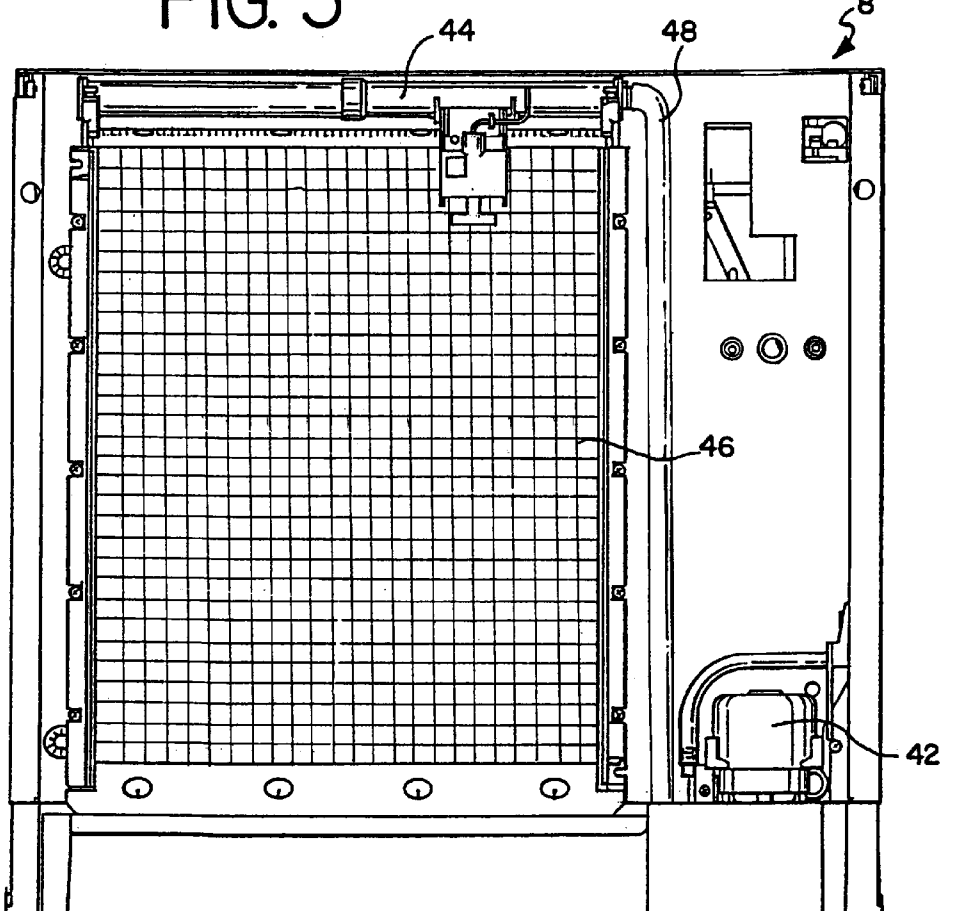
FIG. 6
FIG. 5

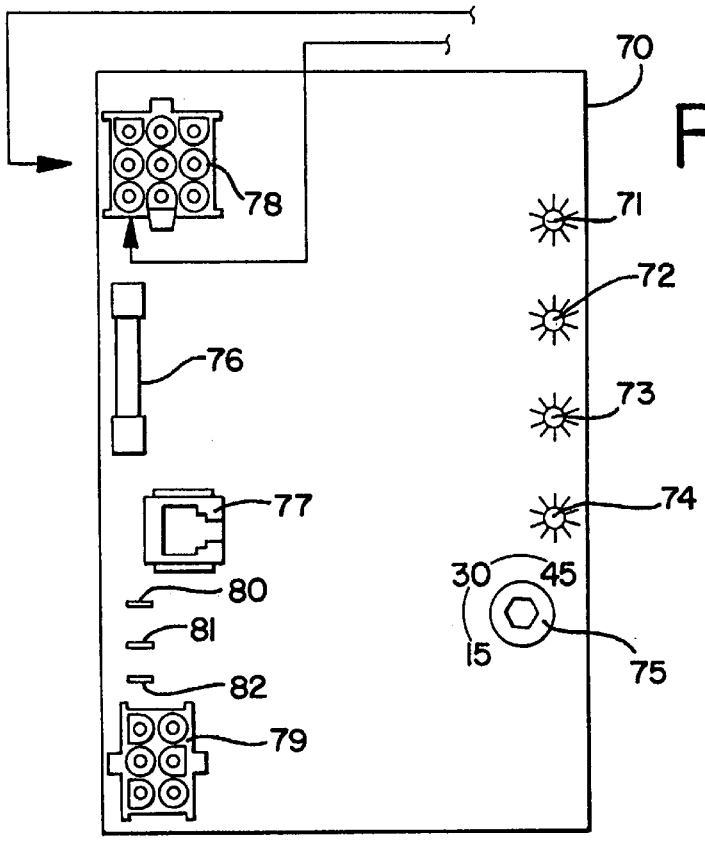
FIG. 11
FIG. 12
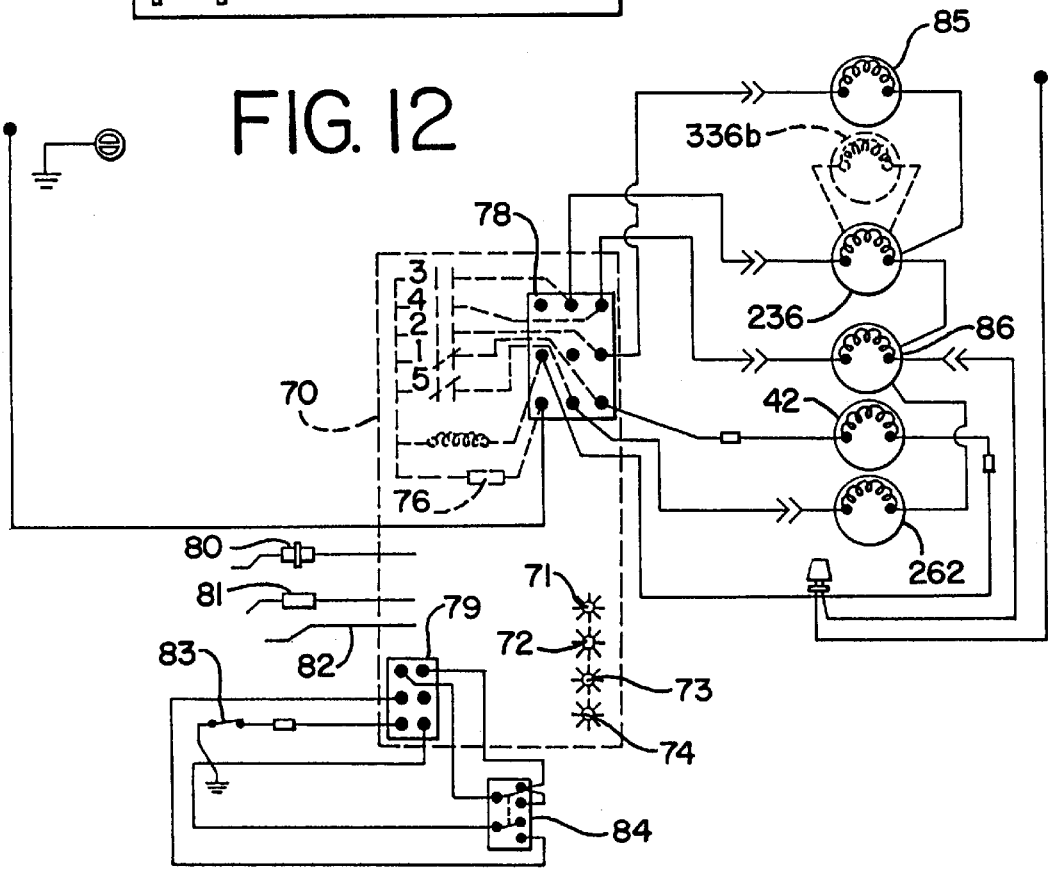

L1
L2
87
254
256
91
92
252
50
93
56
12
R
R
R
S
C
S
S
5
2
1
54
88

L1
L2
L3
87
254
256
91
L2
L1
L3
T2
T3
T1
12
252
50

ICE MAKING MACHINE WITH COOL VAPOR DEFROST

REFERENCE TO EARLIER FILED APPLICATION

The present application claims the benefit of the filing date under 35 U.S.C. §119(e) of Provisional U.S. patent application Ser. No. 60/103,437 filed Oct. 6, 1998, which is hereby incorporated by reference.

BACKGROUND OF THE INVENTION

The present invention relates to automatic ice making machines, and more particularly to an automatic ice making machine where the ice making. evaporator is defrosted in a harvest mode by cool refrigerant vapor.

Automatic ice making machines rely on refrigeration principles well-known in the art. During an ice making mode, the machines transfer refrigerant from the condensing unit to the evaporator to chill the evaporator and an ice-forming evaporator plate below freezing. Water is then run over or sprayed onto the ice-forming evaporator plate to form ice. Once the ice has fully formed, a sensor switches the machine from an ice production mode to an ice harvesting mode. During harvesting, the evaporator must be warmed slightly so that the frozen ice will slightly thaw and release from the evaporator plate into an ice collection bin. To accomplish this, most prior art ice making machines use a hot gas valve that directs hot refrigerant gas routed from the compressor straight to the evaporator, bypassing the condenser.

In a typical automatic ice making machine, the compressor and condenser unit generates a large amount of heat and noise. As a result, ice machines have typically been located in a back room of an establishment, where the heat and noise do not cause as much of a nuisance. This has required, however, the ice to be carried from the back room to where it is needed. Another problem with having the ice machine out where the ice is needed is that in many food establishments, space out by the food service area is at a premium, and the bulk size of a normal ice machine is poor use of this space.

Several ice making machines have been designed in an attempt to overcome these problems. In typical "remote" ice making machines, the condenser is located at a remote location from the evaporator and the compressor. This allows the condenser to be located outside or in an area where the large amount of heat it dissipates and the noise from the condenser fan would not be a problem. However, the compressor remains close to the evaporator unit so that it can provide the hot gas used to harvest the ice. While a typical remote ice making machine solves the problem of removing heat dissipated by the condenser, it does not solve the problem of the noise and bulk created by the compressor.

Other ice machine designs place both the compressor and the condenser at a remote location. These machines have the advantage of removing both the heat and noise of the compressor and condenser to a location removed from the ice making evaporator unit. For example, U.S. Pat. No. 4,276,751 to Saltzman et al. describes a compressor unit connected to one or more remote evaporator units with the use of three refrigerant lines. The first line delivers refrigerant from the compressor unit to the evaporator units, the second delivers hot gas from the compressor straight to the evaporator during the harvest mode, and the third is a common return line to carry the refrigerant back from the evaporator to the compressor. The device disclosed in the Saltzman patent has a single pressure sensor that monitors the input pressure of the refrigerant entering the evaporator units. When the pressure drops below a certain point, which is supposed to indicate that the ice has fully formed, the machine switches from an ice making mode to a harvest mode. Hot gas is then piped from the compressor to the evaporator units.

U.S. Pat. No. 5,218,830 to Martineau also describes a remote ice making system. The Martineau device has a compressor unit connected to one or more remote evaporator units through two refrigerant lines: a supply line and a return line. During an ice making mode, refrigerant passes from the compressor to the condenser, then through the supply line to the evaporator. The refrigerant vaporizes in the evaporator and returns to the compressor through the return line. During the harvest mode, a series of valves redirect hot, high pressure gas from the compressor through the return line straight to the evaporator to warm it. The cold temperature of the evaporator converts the hot gas into a liquid. The liquid refrigerant exits the evaporator and passes through a solenoid valve and an expansion device to the condenser. As the refrigerant passes through the expansion device and the condenser it vaporizes into a gas. The gaseous refrigerant then exits the condenser and returns to the compressor.

One of the main drawbacks of these prior systems is that the long length of the refrigerant lines needed for remote operation causes inefficiency during the harvest mode. This is because the hot gas used to warm the evaporator must travel the length of the refrigeration lines from the compressor to the evaporator. As it travels, the hot gas loses much of its heat to the lines' surrounding environment. This results in a longer and more inefficient harvest cycle. In addition, at long distances and low ambient temperatures, the loss may become so great that the hot gas defrost fails to function properly at all.

Some refrigeration systems that utilize multiple evaporators in parallel have been designed to use hot gas to defrost one of the evaporators while the others are in a cooling mode. For example, in a grocery store with multiple cold and frozen food storage and display cabinets, one or more compressors may feed a condenser and liquid refrigerant manifold which supplies separate expansion devices and evaporators to cool each cabinet. A hot gas defrost system, with a timer to direct the hot gas to one evaporator at a time, is disclosed in U.S. Pat. No. 5,323,621. Hot gas defrosting in such systems is effective even though the compressor is located remotely from the evaporators due to the large latent heat load produced by the refrigerated fixtures in excess of the heat required to defrost selected evaporator coils during the continued refrigeration of the remaining fixtures. While there are some inefficiencies and other problems associated with such systems, a number of patents disclose improvements thereto, such as U.S. Pat. Nos. 4,522,037 and 4,621,505. These patents describe refrigeration systems in which saturated refrigerant gas is used to defrost one of several evaporators in the system. The refrigeration systems include a surge receiver and a surge control valve which allows hot gas from the compressor to bypass the condenser and enter the receiver. However, these systems are designed for use with multiple evaporators in parallel, and would not function properly if only a single evaporator, or if multiple evaporators in series, were used. Perhaps more importantly, these systems are designed for installations in which the cost of running refrigerant lines between compressors in an equipment room, an outdoor condenser, and multiple evaporators in the main part of a store is not a significant factor in the design. These refrigeration systems would not be cost effective, and perhaps not even practicable, if they were applied to ice making machines.

A good example of such a situation is U.S. Pat. No. 5,381,665 to Tanaka, which describes a refrigeration system for a food showcase that has two evaporators in parallel. A receiver supplies vaporous refrigerant to the evaporators through the same feed line as is used to supply liquid refrigerant to the evaporators. The system has a condenser, compressor and evaporators all located separately from one another. Such a system would not be economical if applied to ice machines where different sets of refrigerant lines had to be installed between each of the locations of the various parts. Moreover, if the compressor and its associated components were moved outdoors to be in close proximity to a remote condenser, the system would not be able to harvest ice at low ambient temperature because the receiver would be too cold to flash off refrigerant when desired to defrost the evaporators.

U.S. Pat. No. 5,787,723 discloses a remote ice making machine which overcomes the drawbacks mentioned above. One or more remote evaporating units are supplied with refrigerant from a remote condenser and compressor. Moreover, if a plurality of evaporating units are used, they can be operated independently in a harvest or ice making mode. The heat to defrost the evaporators in a harvest mode is preferably supplied from a separate electrical resistance heater. While electrical heating elements have proved satisfactory for harvesting ice from the evaporator, they add to the expense of the product. Thus, a method of harvesting the ice in the remote ice machine of U.S. Pat. No. 5,787,723 without electrical heating elements would be a great advantage. An ice making machine that includes a defrost system that utilizes refrigerant gas and can be used where the system has only one evaporator, or an economically installed system with multiple evaporators that also operates at low ambient conditions, would also be an advantage.

SUMMARY OF THE INVENTION

An ice making machine has been invented in which the compressor and condenser are remote from the evaporator but does not require electrical heaters to heat the ice-forming mold, nor does it require hot gas to travel to the evaporator from the compressor. In addition, the refrigeration system will function in low ambient conditions, and is not expensive to install.

In one aspect, the invention is an ice making machine comprising: a) a water system including a pump, an ice-forming mold and interconnecting lines therefore; and b) a refrigeration system including a compressor, a condenser, an expansion device, an evaporator in thermal contact with the ice-forming mold, and a receiver, the receiver having an inlet connected to the condenser, a liquid outlet connected to the expansion device and a vapor outlet connected by a valved passageway to the evaporator.

In a second aspect, the invention is a method of making cubed ice in an ice making machine comprising the steps of: a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode; and b) heating the ice making mold to release cubes of ice therefrom in a harvest mode by separating vaporous and liquid refrigerant within a receiver interconnected between the condenser and the expansion device and feeding the vapor from the receiver to the evaporator.

In a third aspect, the invention is an ice making apparatus in which an evaporator is located remotely from a compressor and a condenser comprising: a) a condensing unit comprising the condenser and the compressor; b) an ice making unit comprising i) a water system including a pump, an ice-forming mold and interconnecting lines therefor; and ii) a portion of a refrigeration system including the evaporator in thermal contact with the ice-forming mold, a receiver and a thermal expansion device; and c) two refrigerant lines running between the condensing unit and the ice making unit comprising a suction line and a feed line, the suction line returning refrigerant to the compressor and the feed line supplying refrigerant to the ice making unit; d) the receiver having an inlet, a liquid outlet and a vapor outlet, the inlet being connected to the feed line, the liquid outlet being connected to the expansion device, which in turn is connected to the evaporator, and the vapor outlet being connected by a valved passageway directly to the evaporator.

The use of cool refrigerant vapor from a receiver to defrost an evaporator has several advantages. It eliminates the need for an electrical heating unit, or the problems associated with piping hot gas over a long distance in a remote compressor configuration. Since the cool vapor is located inside the evaporator coil, there is excellent heat transfer to those parts of the system that need to be warmed. The system can be used to defrost the evaporator where there is only one evaporator in the refrigeration system, or multiple evaporators in series, as well as evaporators in parallel.

These and other advantages of the invention will be best understood in view of the attached drawings.

BRIEF DESCRIPTION OF SEVERAL VIEWS OF THE DRAWINGS

FIG. 5 is a front elevational view of the ice making unit of FIG. 4.

FIG. 6 is an elevational view of the receiver used in the ice making machine of FIG. 1.

FIG. 6A is a schematic diagram of an alternate receiver for use in the invention.

FIG. 11 is a schematic drawing showing the location of various components on the control board used in the ice making machine of FIG. 1.

FIG. 12 is a wiring diagram for the ice making unit of FIG. 4.

DETAILED DESCRIPTION OF THE DRAWINGS AND PREFERRED EMBODIMENTS OF THE INVENTION

Figure 1:
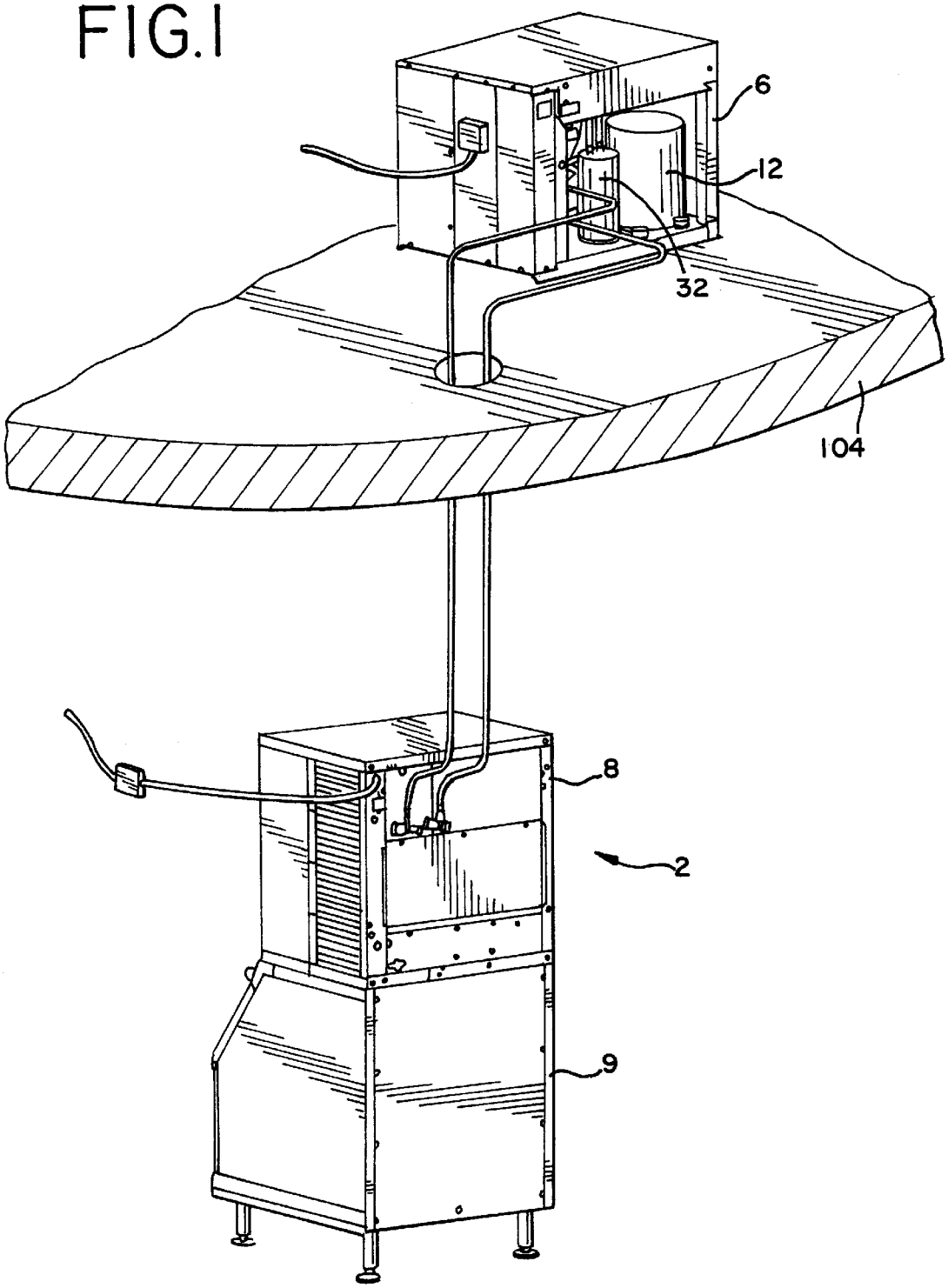
FIG. 1 is a perspective view of a remote ice machine including an ice-making unit and a condensing unit, utilizing the present invention.

FIG. 1 shows the preferred embodiment of the present invention, an automatic ice making apparatus or machine 2 having a condensing unit 6 and an ice making unit B. The condensing unit 6 contains a compressor 12 and condenser with a fan and motor and is generally mounted in a cabinet on the roof 104 of a building, or could be located outside on the ground or in a back room. The ice making unit 8 contains an evaporator and ice-forming mold, and is usually located in the main portion of a building. As shown, the ice making unit 8 typically sits in a cabinet on top of an ice storage bin 9. The present invention can also be used in ice making machines where the compressor and/or condenser are located in the same cabinetry as the evaporator/ice-forming mold. However, in such situations, hot gas defrost works well and thus the invention is more particularly suited to remote ice making equipment. Novel refrigeration systems used in ice machines of the present invention may also be useful in other equipment which include refrigeration systems.

The preferred automatic ice making machine 2 is very similar to a Manitowoc brand remote ice making machine, such as the Model QY 1094 N. Thus, many features of such a machine will not be discussed. Instead, those features by which the present invention differs will primarily be discussed. Some components, such as the compressor 12, will be discussed although there is no difference between that specific component in the Model QY 1094 N remote ice making machine and in the preferred embodiment of the invention. However, reference to these parts common to the prior art and preferred embodiment of the invention is necessary to discuss the new features of the invention.

The present invention is most concerned with the refrigeration system of the ice machine. Several different embodiments of refrigeration systems that could be used to practice the present invention will be discussed first. Thereafter, the total ice making machine will be described.

Figure 8:
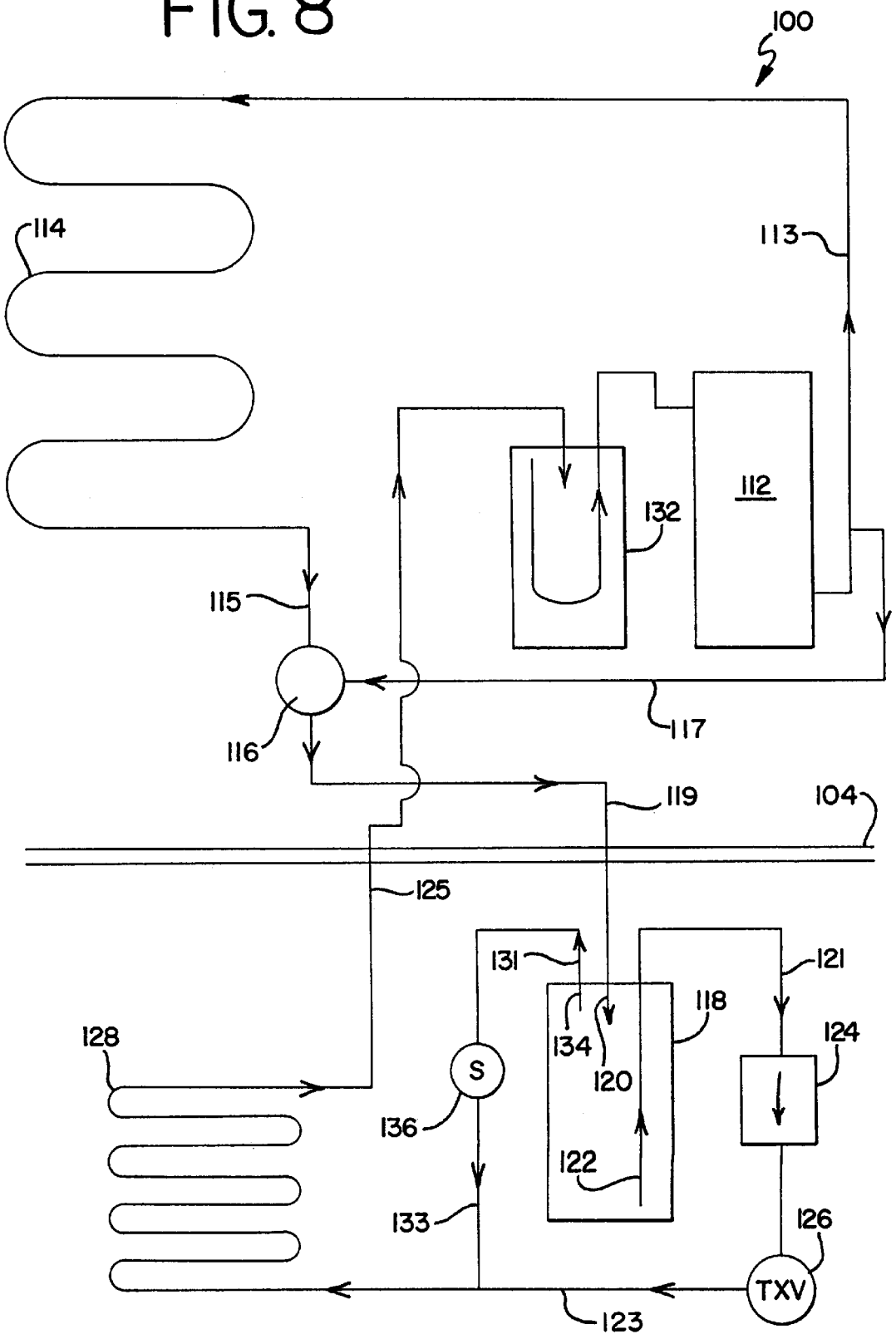
FIG. 8 is a schematic drawing of a second embodiment of a refrigeration system used in the present invention.

FIG. 8 depicts a first preferred embodiment of a refrigeration system 100 that can be used in ice machines of the present invention. The double line across the figure represents the roof 104 of FIG. 1. The system 100 includes a compressor 112 connected to a condenser 114 by refrigerant line 113. While one loop of condenser tubing is shown, it should be understood that the condenser may be constructed with any number of loops of refrigerant tubing, using conventional condenser designs. The refrigerant line 115 from the condenser is connected to head pressure control valve 116. A bypass line 117 from the compressor also feeds into the head pressure control valve, such as a Head Master brand valve. The head pressure control valve 116 is conventional, and is used to maintain sufficient head pressure in the high pressure side of the refrigeration system so that the expansion device and other components of the system operate properly. The head pressure control valve 116 and bypass line 117 are preferred for low ambient temperature operation.

The refrigerant from the head pressure control valve 116 flows into receiver 118 through refrigerant line 119 and inlet 120. Line 119 is often referred to as a feed line or liquid line. However, especially when the head pressure contral valve opens, vaporous refrigerant, or both vaporous and liquid refrigerant, will flow through line 119. Liquid refrigerant is removed from the receiver 118 through a liquid outlet 122, preferably in the form of a tube extending to near the bottom of the receiver 118. Liquid refrigerant travels from the receiver 118 through outlet 122 and refrigerant line 121 through a drier 124 and an expansion device, preferably a thermal expansion valve 126. Refrigerant from the thermal expansion valve 126 flows to evaporator 128 through line 123. From the evaporator 128 the refrigerant flows through line 125 back to the compressor 112, passing through an accumulator 132 on the way. The accumulator 132, compressor 112 and evaporator 128 are also of conventional design.

A unique feature of the refrigeration system 100 is that the receiver 118 has a vapor outlet 134. This outlet is preferably a tube which extends only to a point inside near the top of the receiver. In the system 100, all of the refrigerant enters into the receiver 118. Refrigerant coming into the receiver is separated, with the liquid phase on the bottom and a vapor phase on top. The relative amounts of liquid and vapor in the receiver 118 will be dependent on a number of factors. The receiver 118 should be designed so that the outlet tubes 122 and 134 are positioned respectively in the liquid and vapor sections under all expected operating conditions. During a freeze cycle of an ice machine, the vapor remains trapped in the receiver 118. However, when the system is used during a harvest mode of an ice making machine valve 136 is opened. The passageway between the receiver 118, through vapor outlet 134 and refrigerant lines 131 and 133, to the evaporator 128, is thus opened, and the vapor outlet is connected by the valved passageway directly to the evaporator. Cool vapor, taken off the top of the receiver 118, is then passed through the evaporator, where some of it condenses. The heat given off as the refrigerant is converted to a liquid from a vapor is used to heat the evaporator 128. This results in ice being released from the evaporator in an ice machine.

The amount of vapor in the receiver at the beginning of a harvest cycle may be insufficient to warm the evaporator to a point where the ice is released. However, as vapor is removed from the receiver, some of the refrigerant in the receiver vaporizes, until the receiver gets too cold to vaporize more refrigerant. This also results in a lower pressure on the outlet, or high side, of the compressor.

When the pressure on the high side of the compressor falls below a desired point, the head pressure control valve 116 opens and hot gas from the compressor is fed to the receiver 118 through the bypass line 117 and liquid line 119. This hot vapor serves two functions. First, it helps heat the liquid in the receiver tank 118 to aid in its vaporization. Second, it serves as a source of vapor that mixes with the cold vapor to help defrost the evaporator. However, the vapor that is used to defrost the evaporator is much cooler than the hot gas directly from the compressor in a conventional hot gas defrost system.

In the past it was believed that the sensible heat from the superheated refrigerant in the "hot gas defrost" in an ice machine was needed to heat the evaporator to where it releases the ice. However, in view of the discovery of the present invention, it is appreciated that it is the latent heat from the vapor condensing in the evaporator, rather than the hot gas from the compressor, that is needed for the harvest. Thus, by using a receiver of a unique design, ample amounts of cool vapor refrigerant may be supplied to the evaporator in a harvest mode.

Figure 7:
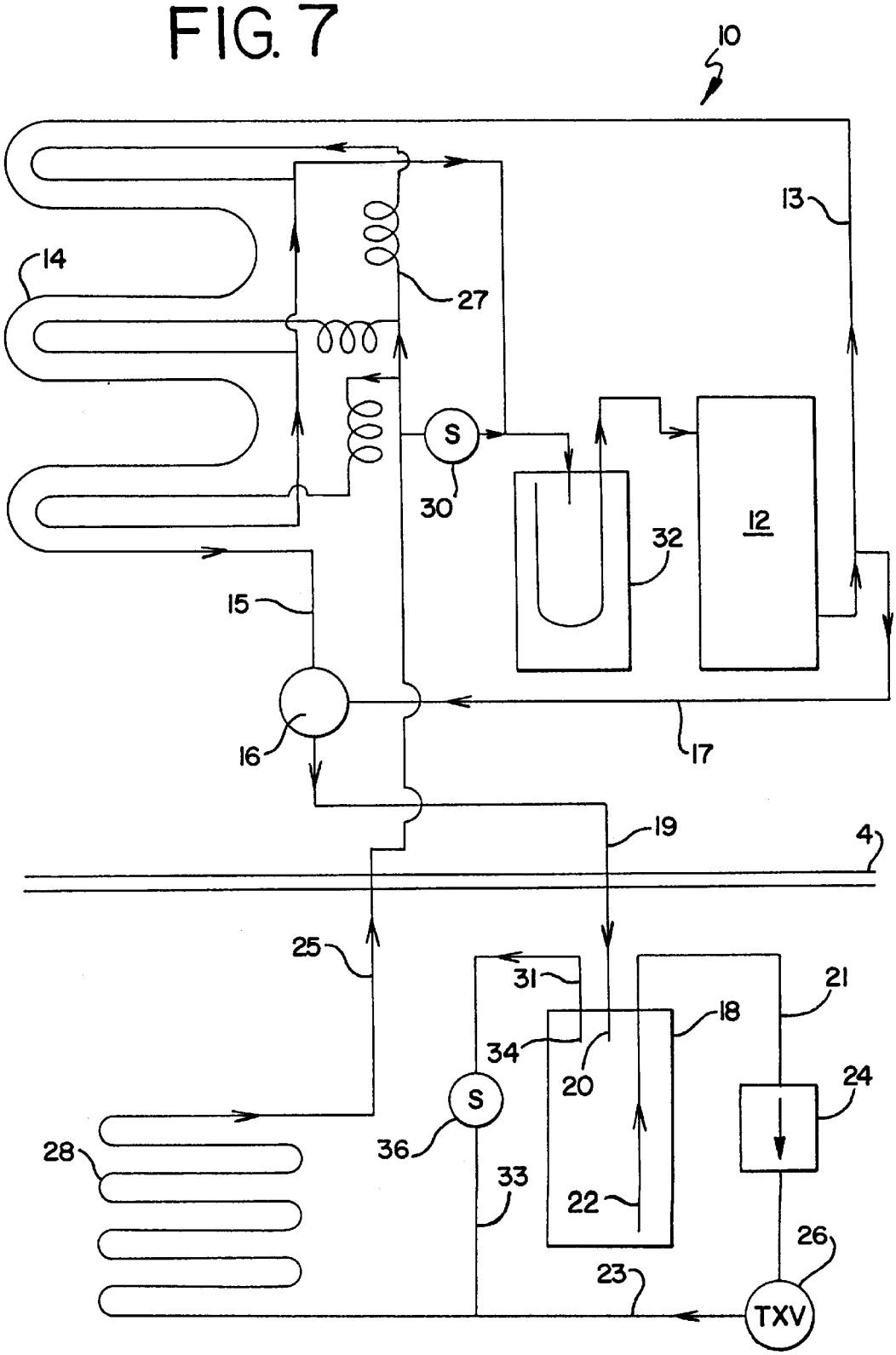
FIG. 7 is a schematic drawing of a first embodiment of a refrigeration system used in the present invention.

FIG. 7 shows a second embodiment of a refrigeration system 10, which was developed prior to the embodiment of FIG. 8. The refrigeration system 10 is just like refrigeration system 100 of FIG. 8 except that solenoid valve 30 and capillary tubes 27 were used in the system 10. The same parts have thus been numbered with the same reference numbers, with a difference of 100. If solenoid valve 30 is closed, the returning refrigerant flows through capillary tubes 27 in heat transfer relationship with the coils of condenser 14. The heat from the condenser helps to vaporize any refrigerant in liquid form returning from the evaporator. It was discovered that the solenoid valve 30 and capillary tubes 27 were unnecessary for proper operation of the refrigeration system in an automatic ice making machine, as the liquid refrigerant coming from the evaporator 128 during the harvest mode would collect in the accumulator 132.

Figure 4:
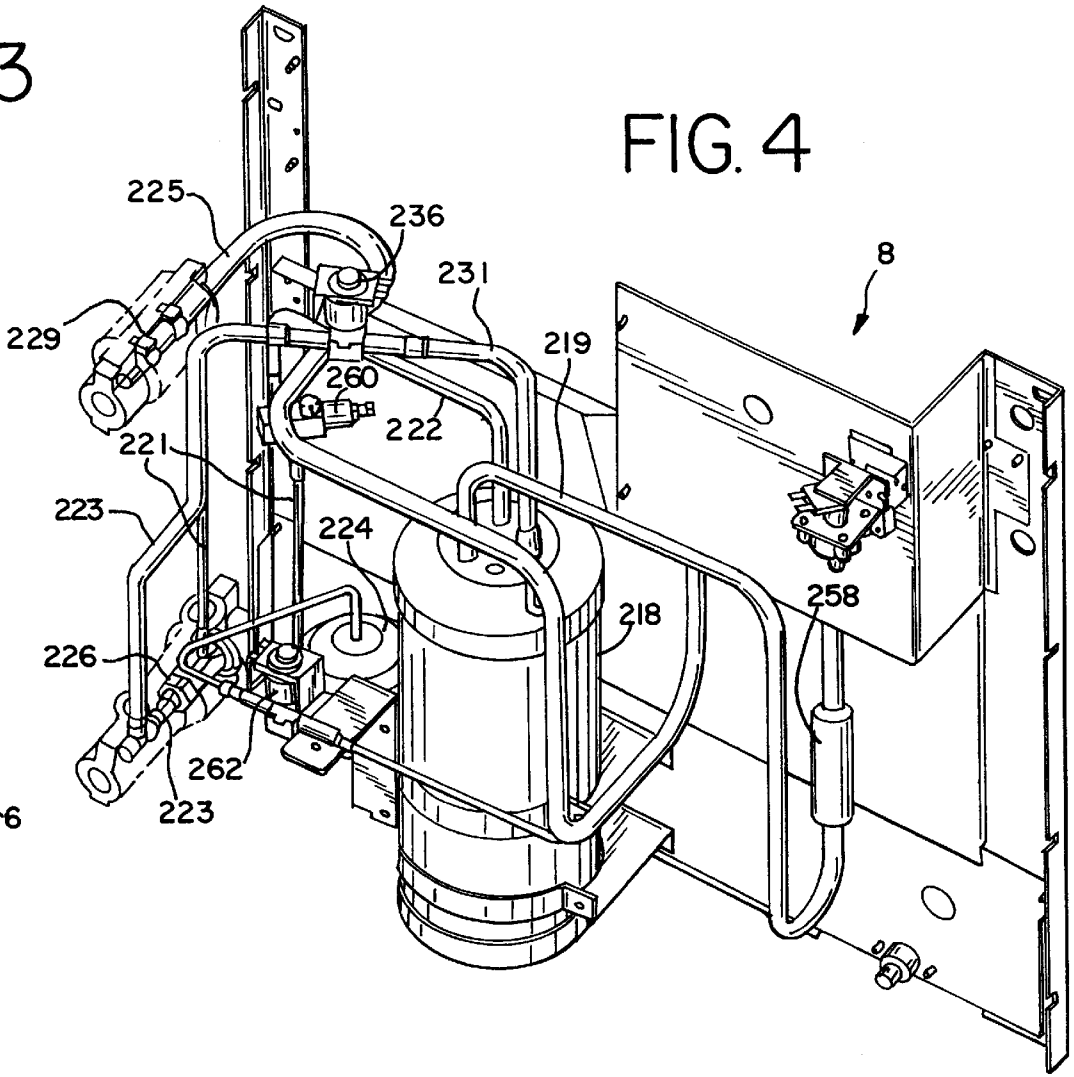
FIG. 4 is a perspective view of the back side of the ice making unit of FIG. 1.
Figure 3:
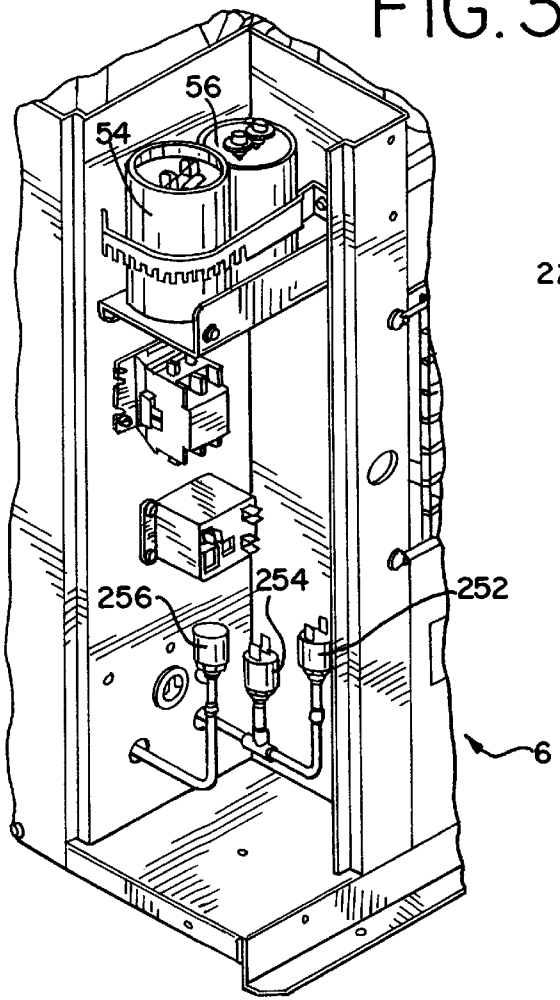
FIG. 3 is a perspective view of the electrical area of the condensing unit of FIG. 2.
Figure 9:
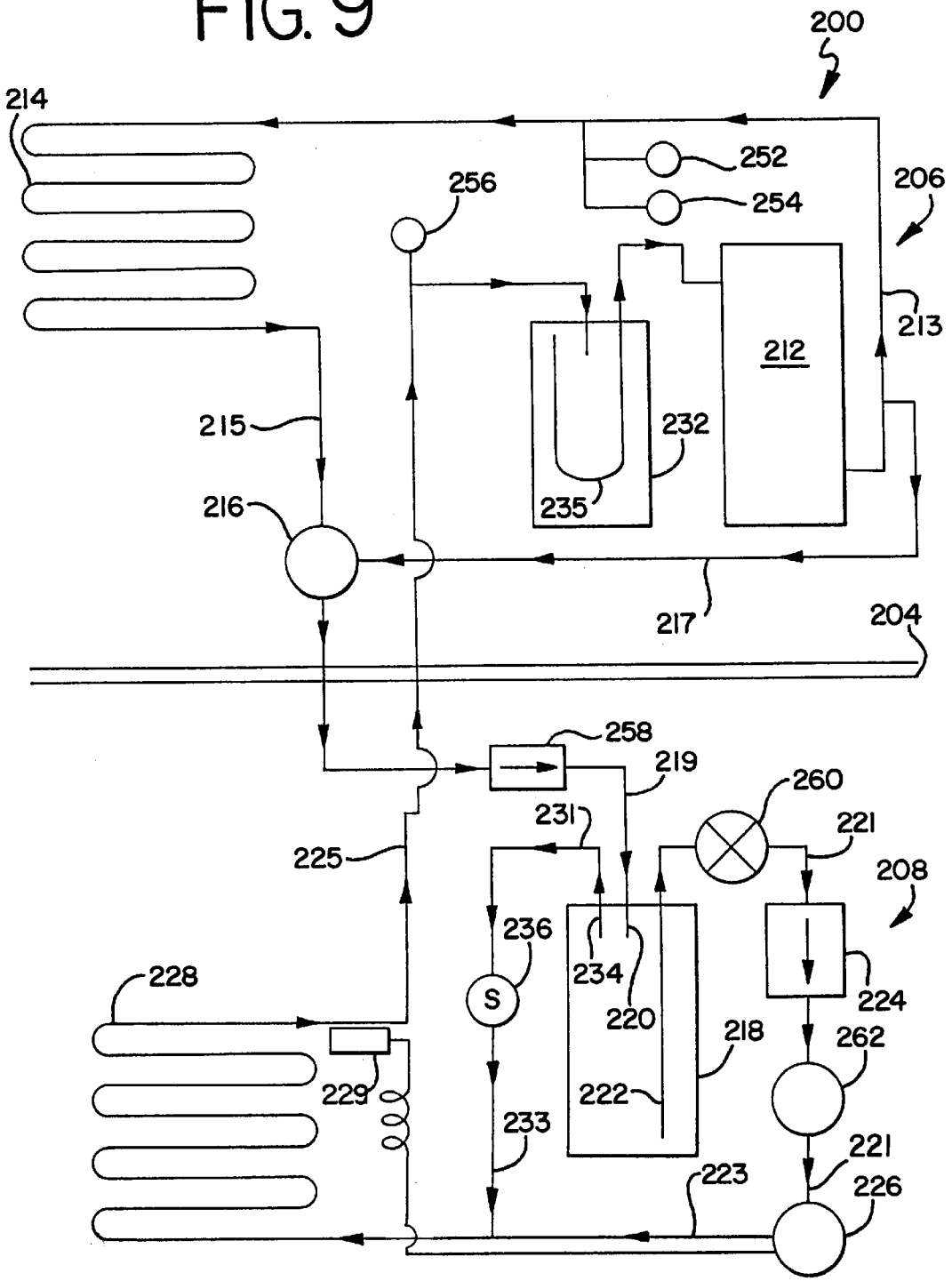
FIG. 9 is a schematic drawing of a third embodiment of a refrigeration system used in the present invention.

FIG. 9 shows a third preferred embodiment of a refrigeration system 200. This refrigeration system is particularly designed for use in an ice making apparatus where a condenser and compressor in condensing unit 206 are located remotely from an evaporator housed in an ice making unit 208. The refrigeration system 200 uses the same components as refrigeration system 100, with a few additional components. The components in system 200 that are the same as the components in system 100 have the same reference numbers, with an addend of 100. Thus, compressor 212 in system 200 may be the same as compressor 112 in system 100. System 200 includes a few more control items. For example, a fan cycling control 252 and a high pressure cut out control 254 are connected to the high pressure side of the compressor 212. A low pressure cutout control 256 is included on the suction side of the compressor 212. These items are conventional, and serve the same functions as in prior art automatic ice making machine refrigeration systems. A check valve 258 is included in the refrigerant line 219 on the inlet side of receiver 218. In addition to drier 224, a hand shut off valve 260 and a liquid line solenoid valve 262 are included in the refrigerant line from the receiver 218 to the thermal expansion valve 226. FIG. 9 also shows the capillary tube and bulb 229 connected to the outlet side of the evaporator 228 which controls thermal expansion valve 226. Not shown in FIG. 9 is the fact that the refrigerant line 221 between the liquid solenoid valve 262 and the thermal expansion valve 226 is preferably coupled in a heat exchange relationship with the refrigerant line 225 coming from the evaporator 228. This is shown in FIG. 4, however. This prechills the liquid refrigerant coming from the receiver 218, as is conventional.

The cold vapor solenoid 236 is operated just like the solenoid valve 136 to allow cool vapor from the receiver 218 to flow into the evaporator 228 during a harvest mode. The head pressure control valve 216 operates just like head pressure control valve 116 to maintain pressure in the high side of the refrigeration system 200.

The J-tube 235 in accumulator 232 preferably includes orifices near the bottom so that any oil in the refrigerant that collects in the bottom of the accumulator will be drawn into the compressor 212, as is conventional.

Sometimes ice machines are built with multiple evaporators. Where a high capacity of ice production is desired, two or more evaporators can produce larger volumes of ice. One evaporator twice as large would conceivably also produce twice the ice, but manufacturing such a large evaporator may not be practicable. The present invention can be used with multiple evaporators.

Figure 10:
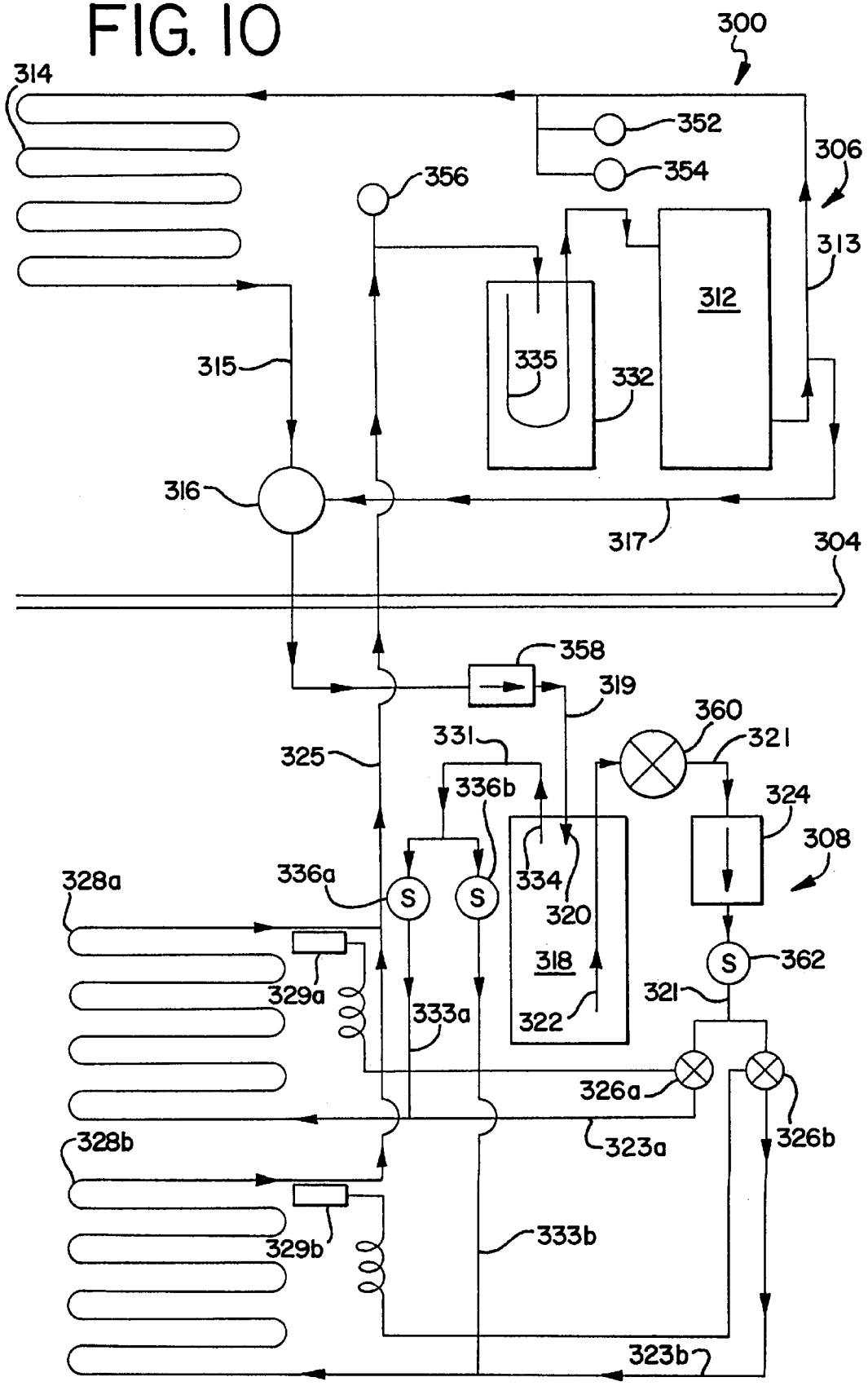
FIG. 10 is a schematic drawing of a refrigeration system used in a dual-evaporator embodiment of the present invention.

FIG. 10 shows a fourth preferred embodiment of a refrigeration system 300 where the ice machine has two evaporators 328*a* and 328*b*. The refrigeration system 300 is just like refrigeration system 200 except some parts are duplicated, as described below. Therefore, reference numbers in FIG. 10 have an addend of 100 compared to the reference numbers in FIG. 9.

Two thermal expansion valves 326*a* and 326*b* are used, feeding liquid refrigerant through lines 323*a* and 323*b* to evaporators 328*a* and 328*b*, respectively. Each is equipped with its own capillary tube and sensing bulb 329*a* and 329*b*. Likewise, two solenoid valves 336*a* and 336*b* are used to control the flow of cool vapor to evaporators 328*a* and 328*b* through lines 333*a* and 333*b*. This allows the two evaporators to each operate at maximum efficiency, and freeze ice at their own independent rate. Of course it is possible to use one thermal expansion valve, but then, because it would be very difficult to balance the demand for refrigerant in each evaporator, one evaporator (the lagging evaporator) would not be full when it was time to defrost the other evaporator.

Having two separate solenoid valves 336*a* and 336*b* allows one valve to be closed once ice has been harvested from the associated evaporator. When it is time to harvest, solenoid valves 336*a* and 336*b* will open, and cool vapor from receiver 318 will be permitted to flow into lines 333*a* and 333*b* and into evaporators 328*a* and 328*b*. Both evaporators go into harvest at the same time. However, once ice falls from evaporator 328*a*, the valve 336*a* will shut, and evaporator 328*a* will be idle while evaporator 328*b* finishes harvesting. With valve 336*a* shut, cool vapor is not wasted in further heating evaporator 328*a*, but rather is all used to defrost evaporator 328*b*. Of course, the reverse is also true if evaporator 328*b* harvests first.

The receiver of the present invention must be able to separate liquid and vaporous refrigerant, and have a separate outlet for each. The vapor drawn off of the receiver will not normally be at saturation conditions, especially when the head pressure control valve is opened, because heat and mass transfer between the liquid and vapor in the receiver is fairly limited. In the preferred embodiment, the receiver 18 (FIG. 6) is generally cylindrical in shape, and is positioned so that the wall of the cylinder is vertical when in use (FIG. 4). Preferably, all of the inlet and outlet connections pass through the top of the receiver. This allows the receiver to be constructed with only one part that need holes in it, and the holes can all be punched in one punching operation to minimize cost. The inlet tube 20 can terminate anywhere in the receiver, but preferably terminates near the top. The liquid outlet 22 terminates near the bottom, and the vapor outlet 34 terminates near the top. Thus it is most practical to have all three tubes pass through the top end panel of the cylinder. Of course other receiver designs can be used, as long as cool vapor can be drawn from the receiver to feed the evaporator during harvest or defrost modes. FIG. 6A shows another receiver 418 where inlet 420 is mounted in the sidewall of the receiver 418. The liquid outlet 422 also exits through the side wall of the receiver, but has a dip tube at a 90° bend so that the end of the outlet tube 422 is near the bottom of the receiver 418. Similarly, vapor outlet 434 is mounted in the side but has an upturned end so that cool vapor from near the top of the receiver 418 will be drawn off.

The head pressure control valve performs two functions in the preferred embodiment of the invention. During the freeze mode, especially at low ambient temperatures, it maintains minimum operating pressure. During the harvest mode, it provides a bypass. If no head pressure control valve were used, the harvest cycle would take longer, more refrigerant would be needed in the system, and the receiver would get cold and sweat. Instead of a head pressure control valve, line 217 could join directly into line 215 and a second solenoid valve could be used in line 217 (FIG. 9) to allow compressed refrigerant from the compressor to go directly to the receiver 218. However, then the electrical controls would require wiring to run between the condensing unit 206 (comprising the compressor and condenser) and the ice making unit 208 (comprising the evaporator and the receiver). With the preferred design of FIG. 9, those two sections can be separated by a roof 204 or wall and a great distance, and only two refrigerant lines need to run between the sections. Thus the ice making unit 208 can be located inside of a building, even close to where customers may want to receive ice cubes, and the compressor and condenser can be located outdoors, where the heat and noise associated with them will not disturb occupants of the building.

The refrigeration system of FIG. 9 can be used with the other components of a typical remote ice making machine with little change. For example, the control board for an electronically controlled remote ice making machine can be used to operate an ice making machine using the refrigeration system of FIG. 9. Instead of the control board signaling the opening of a hot gas defrost valve at the beginning of a harvest cycle, the same signal can be used to open solenoid valve 236. However, compared to the typical remote ice making machine, the compressor can now be located outdoors with the condenser.

The other components of the ice making machine can be conventional. For example, the ice machine will normally include a water system (FIG. 5) comprising a water pump 42, a water distributor 44, an ice-forming mold 46 and interconnecting water lines 48. The ice forming mold 46 is typically made from a pan with dividers in it defining separate ice cube compartments and the evaporation coil is secured to the back of the pan. The ice machine can also include a cleaning system and electronic controls as disclosed in U.S. Pat. No. 5,289,691, or other components of ice machines disclosed in U.S. Pat. Nos. 5,193,357; 5,140,831; 5,014,523; 4,898,002; 4,785,641; 4,767,286; 4,550,572; and 4,480,441, each of which is hereby incorporated by reference. For example, a soft plug is often included in a refrigeration system so that if the ice machine is in a fire, the plug will melt before any of the refrigeration system components explode.

Figure 2:
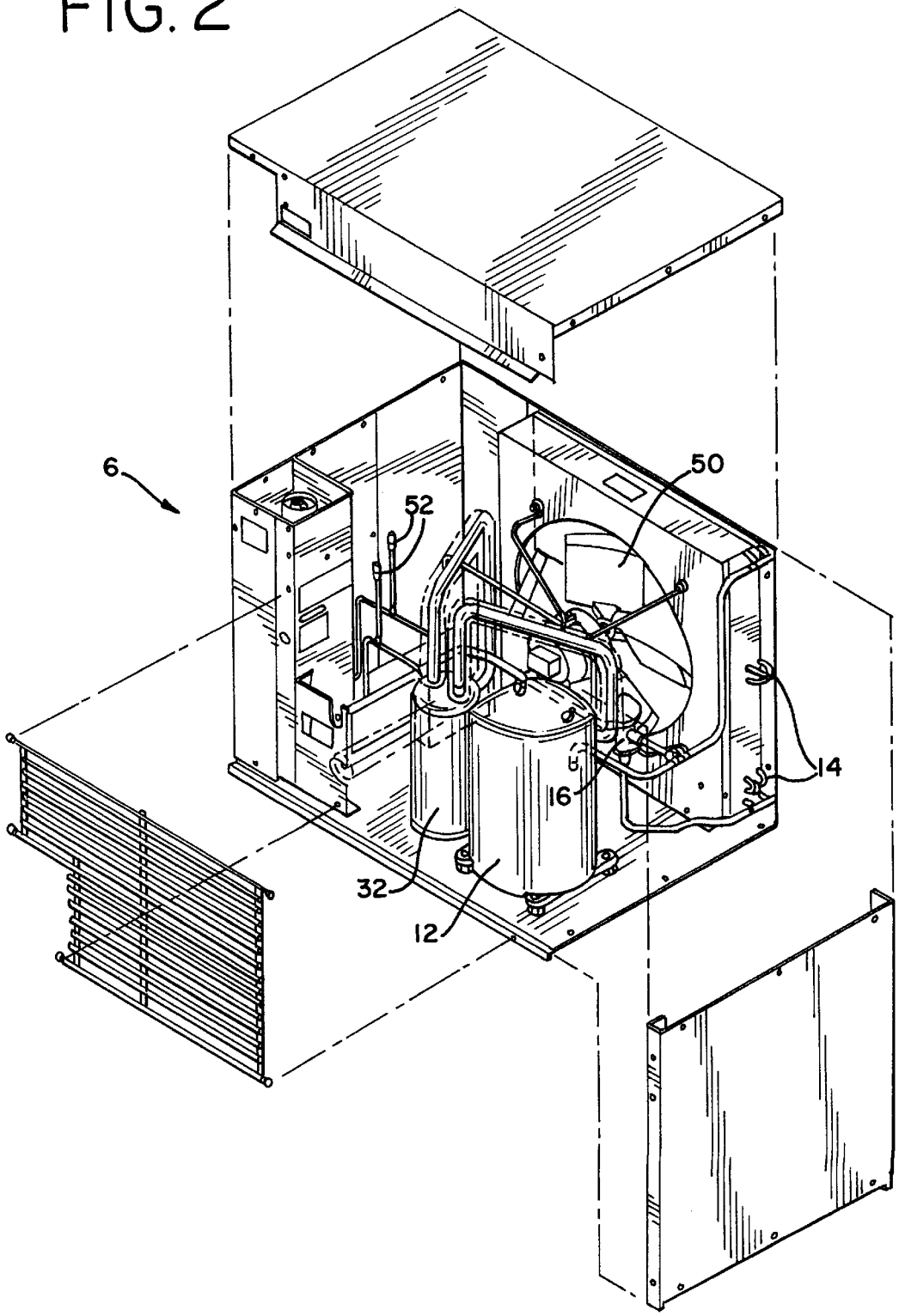
FIG. 2 is an exploded view of the condensing unit of FIG. 1.

Typical components in the condensing unit 6 are shown in FIG. 2. Beside the compressor 12 and condenser 14, which is made of serpentine tubing (only the bends of which can be seen), the condensing unit will also include a condenser fan 50 and motor, access valves 52, the head pressure control valve 16 and the accumulator 32. Electrical components, such as a compressor start capacitor 54, run capacitor 56, relays, the fan cycling control 252, the high pressure cutout control 254, and the low pressure cutout control 256 are typically contained in an electrical section in one corner of the condensing unit 6.

The ice making unit 8 holds the portion of the refrigeration system shown in FIG. 4 as well as the water system shown in FIG. 5. In this instance, the components from refrigeration system 200 are depicted as being in the ice making unit 8. However, the refrigeration system 10 or the refrigeration system 100 could also be used. Besides the evaporator 228 and receiver 218, the ice making unit 8 preferably also includes the drier 224, liquid solenoid valve 262, check valve 258, solenoid valve 236 and thermal expansion valve 226. Because the receiver 218 is preferably built into the same cabinet as the evaporator 228, it will normally be in room temperature ambient conditions. As a result, the receiver is kept fairly warm, which helps provide sufficient vapor to harvest the ice.

FIG. 11 depicts a control board 70 for use with the ice machine 2. The elements on the control board can preferably be the same as the elements on a control board for the Model QY 1094 N remote ice machine from Manitowoc Ice, Inc. Lights 71, 72, 73 and 74 indicate, respectively, whether the machine is in a cleaning mode, if the water level is low, whether the ice bin is full, and whether the machine is in a harvest mode. There is also a timing adjustment 75 for a water purge that occurs between each freezing cycle. The control system fuse 76 and automatic cleaning system accessory plug 77 are also found on the control board, as are the AC line voltage electrical plug 78 and DC low voltage electrical plug 79. The control board also includes spade terminations 80, 81 and 82 respectively for an ice thickness probe, water level probe and an extra ground wire for a cleaning system.

FIG. 12 is a wiring diagram for the ice making unit 8. In addition to the control board 70 and many of its components, FIG. 12 shows wiring for a bin switch 83 and an internal working view of the cleaning selector toggle switch 84 for which the top position is for normal ice making operation, the middle position is the off position and the bottom position is the cleaning mode. FIG. 12 also shows the wiring for a water valve 85, cool vapor solenoid valve 236 (and in dotted lines, the second valve **336*b* when dual evaporators are used), a water dump solenoid 86, the water pump 42, and the liquid line solenoid valve 262**.

Figure 13:
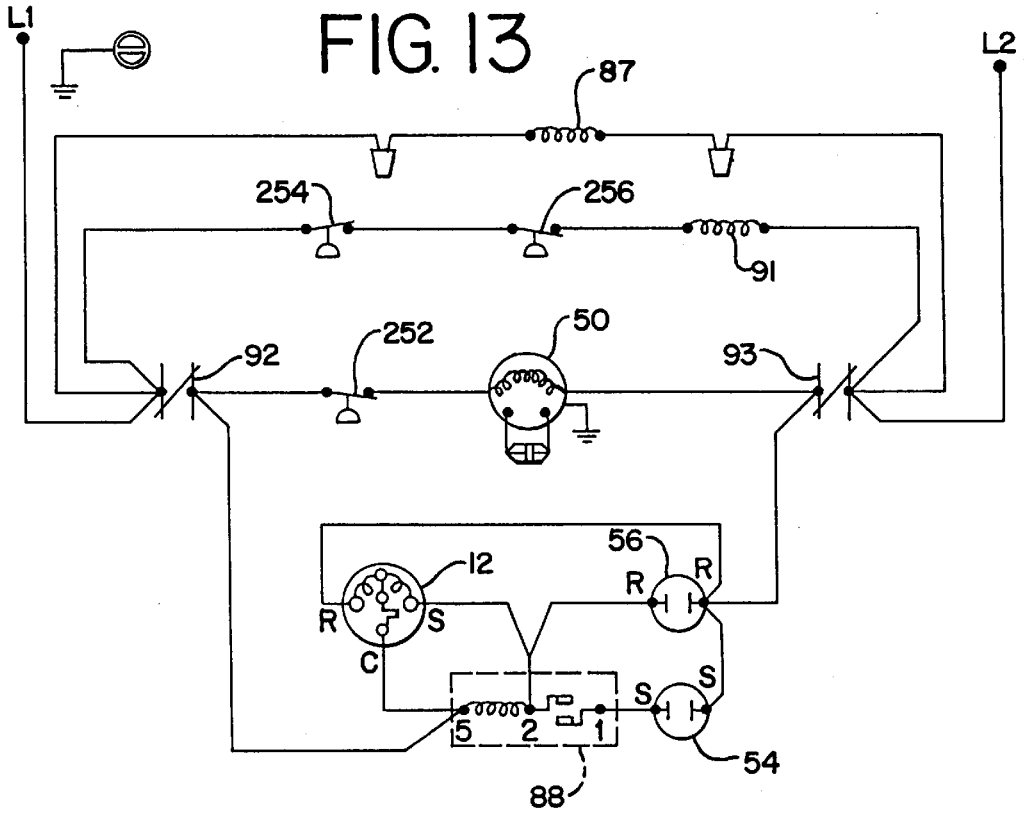
FIG. 13 is a wiring diagram for the condensing unit of FIG. 2 using single phase AC current.

FIG. 13 is a wiring diagram, showing the circuits during the freeze cycle, for the condensing unit 6 using 230V single phase alternating current. The compressor 12 main motor is shown, along with a crank case heater 87. The high pressure cut out 254, low pressure cut out 256, fan cycle control 252 and condenser fan motor 50 with a built in run capacitor are also shown, along with the compressor run capacitor 56 and start capacitor 54. A relay 88, a contactor coil 91 and contactor contacts 92 and 93 are also shown.

Figure 14:
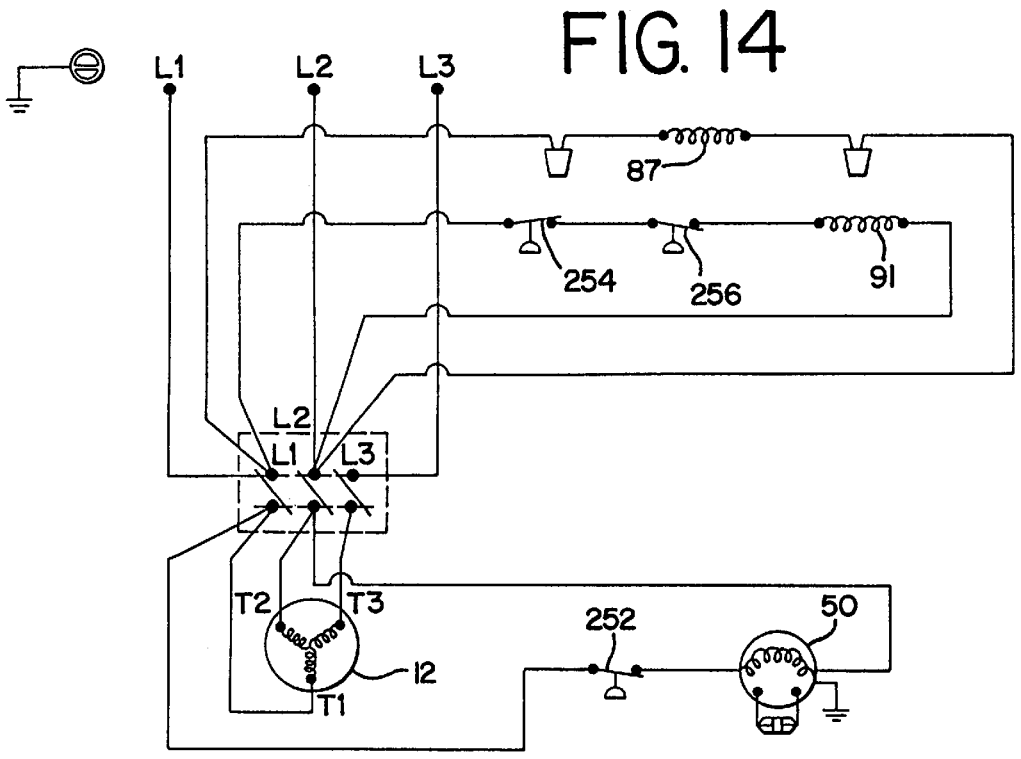
FIG. 14 is a wiring diagram for the condensing unit of FIG. 2 using three phase AC current.

FIG. 14 is a wiring diagram, again showing connections during the freeze cycle, for the condensing unit 6 using 230V three phase alternating current. Components that are the same as those in FIG. 13 have the same reference numbers.

As noted above, there is no need to run electrical wire between the condensing unit 6 and the ice making unit 8. The ice making unit 8 preferably operates off of a standard wall outlet circuit, whereas higher voltage will normally be supplied to the condensing unit 6.

The present invention allows for the compressor and condenser to be located remotely, so that noise and heat are taken out of the environment where employees or customers use the ice. However, the evaporator harvests using refrigerant. Test results show that these improvements are obtained without loss of ice capacity, with comparable harvest time and comparable energy efficiency. Further, since hot gas defrost is eliminated, the compressor is stressed less during the harvest cycle, which is expected to improve compressor life. Only two refrigerant lines are needed, because any hot gas from the head pressure control valve can be pushed down the liquid line with liquid refrigerant from the condenser, and then separated later in the receiver.

Preferably the refrigeration system uses an extra large accumulator directly before the compressor that separates out any liquid refrigerant returned during the harvest cycle. Vapor refrigerant passes through the accumulator. Liquid refrigerant is trapped and metered back at a controlled rate through the beginning of the next freeze cycle.

The compressor preferably pumps down all the refrigerant into the "high side" of the system (condenser and receiver)

so no liquid can get into the compressor crank case during an off cycle. A magnetic check valve is preferably used to prevent high side refrigerant migration during off cycles. The crank case heaters prevent refrigerant condensation in the compressor crank case during off periods at low ambient temperatures.

Commercial remote embodiments of the invention are designed to work in ambient conditions in the range of −20 to 130° F. Preferably the ice making unit is precharged with refrigerant and when the line sets are installed, a vacuum is pulled after the lines are brazed in, and then evacuation valves are opened and refrigerant in the receiver is released into the system. The size of the various refrigerant lines will preferably be in accordance with industry standards. Also, as is common, the accumulator will preferably include an orifice.

The preferred amount of refrigerant in the system will depend on a number of factors, but can be determined by routine experimentation, as is standard practice in the industry. The minimum head pressure should be chosen so as to optimize system performance, balancing the freeze and harvest cycles. The size of orifice in the accumulator should also be selected to maximize performance while taking into account critical temperatures and protection for the compressor. These and other aspects of the invention will be well understood by one of ordinary skill in the art.

It should be appreciated that the systems and methods of the present invention are capable of being incorporated in the form of a variety of embodiments, only a few of which have been illustrated and described above. The invention may be embodied in other forms without departing from its spirit or essential characteristics. For example, rather than using an ice-forming evaporator made from dividers mounted in a pan with evaporator coils on the back, other types of evaporators could be used. Also, instead of water flowing down over a vertical evaporator plate, ice could be formed by spraying water onto a horizontal ice-forming evaporator.

While the ice machine of the preferred embodiment has been described with single components, some ice machines may have multiple components, such as two water pumps, or two compressors. Further, two completely independent refrigeration systems can be housed in a single cabinet, such as where a single fan is used to cool two separate but intertwined condenser coils. While not preferred, a system could be built where one compressor supplied two independently operated evaporators, where extra check valves and other controls were used so that one evaporator could be in a defrost mode while the other evaporator was in a freeze mode.

It will be appreciated that the addition of some other process steps, materials or components not specifically included will have an adverse impact on the present invention. The best mode of the invention may therefore exclude process steps, materials or components other than those listed above for inclusion or use in the invention. However, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. An ice making machine comprising:

a) a water system including a pump, an ice-forming mold and interconnecting lines therefore; and b) a refrigeration system including a compressor, a condenser, an expansion device, an evaporator in thermal contact with said ice-forming mold, a head pressure control valve and a receiver, the receiver having an inlet connected to the condenser, a liquid outlet connected to the expansion device and a vapor outlet connected by a valved passageway to the evaporator, and the head pressure control valve allowing refrigerant from the compressor to bypass the condenser and enter the receiver.

2. The ice making machine of claim 1 wherein the compressor and condenser are remote from the evaporator and the receiver is located in close proximity to the evaporator.

3. The ice making machine of claim 1 wherein the receiver is generally cylindrical in shape, with a wall and two ends, and has lines for the inlet, vapor outlet and liquid outlet all passing through one end of the cylinder.

4. The ice making machine of claim 3 wherein the receiver is positioned so that the wall of the cylinder is vertical and the inlet, vapor outlet and liquid outlet all pass through the top end of the receiver, with the liquid outlet comprising a tube extending to near the bottom of the receiver and the vapor outlet comprising a tube terminating near the top of the receiver.

5. The ice making machine of claim 1 wherein the receiver has a top end, a bottom end and a sidewall, and the vapor outlet and liquid outlet pass through the sidewall and connect to tubes bent to reach respectively near the top end and bottom end inside the receiver.

6. The ice making machine of claim 1 wherein the valved passageway comprises a solenoid valve.

7. The ice making machine of claim 1 comprising at least two ice-forming molds and at least two evaporators, each evaporator being in thermal contact with a different one of said ice-forming molds and the vapor outlet branching into at least two valved passageways, each branch being connected to a different one of said evaporators.

8. A method of making ice in an ice making machine comprising the steps of:

a) compressing vaporized refrigerant, cooling the compressed refrigerant to condense it into a liquid, feeding the condensed refrigerant through an expansion device and vaporizing the refrigerant in an evaporator to create freezing temperatures in an ice-forming mold to freeze water into ice in the shape of mold cavities during an ice making mode; and b) heating the ice making mold to release the ice therefrom in a harvest mode by separating vaporous and liquid refrigerant within a receiver interconnected between the condenser and the expansion device and feeding vapor from the receiver to the evaporator, wherein the ice-forming mold, evaporator and receiver are installed in one room of a building, and the compressor and condenser are located outside of said room.

9. The method of claim 8 further comprising, during the harvest mode, the step of feeding vaporous refrigerant to the receiver from the compressor by bypassing the condenser through a head pressure control valve.

10. The method of claim 8 wherein during the ice making mode liquid refrigerant passes from the condenser to the receiver through a liquid line and during the harvest mode vaporous refrigerant passes through said liquid line into the receiver.

11. The method of claim 8 wherein the ice making machine has two ice making molds, each with one of two different evaporators in thermal contact therewith and wherein vapor is fed from the receiver to both evaporators while in a harvest mode and the flow of vaporized refrigerant to one of the evaporators is stopped when ice has been released therefrom, while vaporized refrigerant still flows to the second evaporator.

12. An ice making apparatus in which an evaportor is located remotely from a compressor and a condenser comprising:

a) an ice making unit comprising a cabinet housing
   i) a water system including a pump, an ice-forming mold and interconnecting lines therefore; and
   ii) a portion of a refrigeration system including said evaporator in thermal contact with said ice-forming mold, a receiver and a thermal expansion device;

b) a condensing unit comprising said condenser and said compressor located outside of the ice making unit cabinet; and c) two refrigerant lines running between the condensing unit and the ice making unit comprising a suction line and a feed line, the suction line returning refrigerant to the compressor and the feed line supplying refrigerant to the ice making unit;

d) the receiver having an inlet, a liquid outlet and a vapor outlet, the inlet being connected to the feed line, the liquid outlet being connected to the expansion device, which in turn is connected to the evaporator, and the vapor outlet being connected by a valved passageway directly to the evaporator.

13. The ice making apparatus of claim 12 wherein the condensing unit further comprises a head pressure control valve which allows refrigerant from the compressor to bypass the condenser and enter the feed line as a vapor.

14. The ice making apparatus of claim 12 further comprising an accumulator located in the condensing unit and interposed in the suction line.

15. The ice making apparatus of claim 12 wherein the ice making unit comprises two ice-forming molds and two evaporators, one of each of said ice-forming molds being in thermal contact with a different one of said evaporators, and wherein the vapor outlet is connected by two passageways to said evaporators, each passageway having a valve and being connected to a different one of said evaporators.

16. The ice making apparatus of claim 12 wherein the ice making unit further comprises a water distributor.

17. An ice making machine comprising:

a) a water system including a pump, an ice-forming mold and interconnecting lines therefore; and b) a refrigeration system including a compressor, a condenser, an expansion device, an evaporator in thermal contact with said ice-forming mold, and a receiver, the receiver having an inlet connected to the condenser, a liquid outlet connected to the expansion device and a vapor outlet connected by a valved passageway to the evaporator;

c) the compressor and condenser being contained within a condensing unit and the water system, evaporator and receiver being contained within an ice making unit, the condensing unit and ice making unit being housed in separate cabinets.

18. An installed ice making machine comprising:

a) a water system including a pump, an ice-forming mold and interconnecting lines therefore; and b) a refrigeration system including a compressor, a condenser, an expansion device, an evaporator in thermal contact with said ice-forming mold, and a receiver, the receiver having an inlet connected to the condenser, a liquid outlet connected to the expansion device and a vapor outlet connected by a valved passageway to the evaporator;

c) the water system, evaporator and receiver being installed in one room of a building, and the compressor and condenser being located outside of said room.

19. The method of claim 8 wherein vaporous refrigerant is fed to the receiver from the compressor by bypassing the condenser through a bypass valve during the harvest mode.

20. The method of claim 19 wherein the bypass valve comprises a solenoid valve.

21. The method of claim 8 wherein the ice is formed in a cube shape.

22. The ice making machine of claim 17 wherein the machine is capable of operation when the condensing unit is located outdoors and subject to ambient temperatures in the range of −20 to 130° F.

23. The ice making machine of claim 1 wherein the receiver inlet is connected to the condenser through the head pressure control valve.

24. The ice making apparatus of claim 12 further comprising a check valve in the refrigeration system between the condenser and the receiver.

25. The ice making apparatus of claim 12 further comprising a liquid line solenoid valve between the receiver and the thermal expansion device.

26. The installed ice making machine of claim 18 wherein the condenser is cooled by a fan and the ice making machine further comprises a fan cycle control switch.

* * * * *